US005702195A

United States Patent [19]

Rittenbaum

[11] Patent Number: 5,702,195

[45] Date of Patent: Dec. 30, 1997

[54] WASHING BRUSH

[75] Inventor: Jeffrey Alan Rittenbaum, Atlanta, Ga.

[73] Assignee: Max Rittenbaum, Inc., Atlanta, Ga.

[21] Appl. No.: 601,869

[22] Filed: Feb. 15, 1996

[51] Int. Cl.[6] ..... A46B 11/06

[52] U.S. Cl. ..... 401/289; 15/221; D4/115; D4/132; D32/50; 401/268; 401/266; 401/203; 401/288

[58] Field of Search ..... 401/289, 268, 401/140, 286, 288, 285, 266, 290, 203; 15/221; D4/114, 115, 132, 134; D32/50

[56] References Cited

U.S. PATENT DOCUMENTS

| | | | |
|---|---|---|---|
| 17,230 | 3/1857 | White . | |
| 30,728 | 5/1860 | Hoke, Jr. . | |
| 1,778,552 | 10/1930 | Floyd | 401/289 X |
| 1,834,510 | 12/1931 | Yeater | 401/289 X |
| 1,990,619 | 2/1935 | Schumann . | |
| 3,008,160 | 11/1961 | West . | |
| 3,134,129 | 5/1964 | Allen | 401/140 X |
| 3,763,516 | 10/1973 | Welter . | |
| 4,032,239 | 6/1977 | Maupin | 401/203 |
| 4,498,206 | 2/1985 | Braukmann . | |
| 4,961,662 | 10/1990 | Chow et al. | 401/204 X |
| 5,327,611 | 7/1994 | Balster et al. . | |

FOREIGN PATENT DOCUMENTS

| | | | |
|---|---|---|---|
| 2044090 | 10/1980 | United Kingdom | 401/289 |

*Primary Examiner*—Steven A. Bratlie

*Attorney, Agent, or Firm*—Jacobson, Price, Holman & Stern PLLC

[57] ABSTRACT

A brush curved having a brush head with a central portion from which extend two arm or wing portions. The wing portions extend away from the central portion at a separation angle of approximately 70° to 90°, and preferably 75° to 85°, and more preferably at an angle of 80°. Extension of the wings away from a common side of the central portion forms a curved pocket or cup cleaning channel at one edge of the bristles or sponge-like material of the brush. This cleaning channel serves to funnel dirty water away from the contoured surface of an automobile being cleaned. Water is swept across the contoured surface, making drying of the contoured surface less of a chore.

13 Claims, 3 Drawing Sheets

WASHING BRUSH

FIELD OF THE INVENTION

The present invention relates to the field of washing brushes, whether of a bristle or a sponge-like material type, useful for washing automobiles or other contoured surfaces.

BACKGROUND OF THE INVENTION

Conventional brushes are usually formed in a rectangular, round, oval or other geometric shape. As is known in the use of rectangular shaped brushes, dirt collected by the application of the brush to a contoured surface, usually collects at the edges of the brush. The collected dirt, upon application of pressure, can be released onto the surface being cleaned, thereby defeating the purpose of the use of the brush.

SUMMARY OF THE INVENTION

Accordingly, it is an object of the present invention to overcome the disadvantages of known brushes used to clean contoured surfaces.

This object is achieved by the use of a curved brush having a brush head with a central portion from which extend two arm or wing portions. The wing portions extend away from the central portion at a separation angle of approximately 70° to 90°, preferably 75° to 85°, and more preferably at an angle of 80°. Extension of the wing portions away from a common side of the central portion forms a curved pocket or cup cleaning channel at one edge of the bristles or sponge-like material of the brush. This cleaning channel serves to funnel dirty water away from the contoured surface of an automobile being cleaned by the brush of the present invention.

The overall shape of the brush is thereby useful in moving water across a contoured surface by the pocket formed between the wings extending from one side of the central portion of the brush. Water is swept across a contoured surface, making drying of the contoured surface less of a chore.

The brush head is made of plastic. The overall dimensions of the head are approximately 9.2 inches long and 4.1 inches wide, measuring from one side of the central portion to the furthest edge of a wing portion.

An inlet opening in the brush head for connection with a water hose or an extension handle, is formed in the same side edge of the central portion of the brush head from which the two wing portions extend. The inlet opening extends into the center of the lower surface of the brush head so as to release water in the center of the bristles or sponge-like material which is secured to the brush head. The diameter of the passageway for transfer of water is reduced in the interior of the brush head.

Accordingly, the pressure of the water travelling through the brush head is increased as the water approaches an outlet of the brush head. Water is thereby able to be dispersed evenly from a central portion of the underside of the brush head for uniform flow of water across the contoured surfaces being cleaned by the brush.

The brush head also includes a plurality of ridges located on the upper side of the brush head which generally follow the contour of the brush head, with a central portion and diverging wing portions. Four ridges define channels therebetween. The ridges are of gradually increasing height, moving in a direction from one side of one central portion towards the opposite side of the central portion from which the wings extend and in which the water inlet is formed.

Accordingly, it is another object of the present invention to provide a brush head having a central portion and two wing portions extending from the central portion with the wing portions extending from the same side of the central portion to form a U-shaped brush.

It is still another object of the present invention to provide a brush head having a central portion and two wing portions extending from one side of the central portion to define a pocket between the wing portions for collecting water and removing the water from a contoured surface onto which the brush of the present invention is applied.

It is still yet another object of the present invention to provide a brush, made of bristles or a sponge-like material, having a central portion with two wing portions extending from one side of the central portion with the wings diverging from each other at an angle of 70° to 90°, preferably 75° to 85°, and most preferably at approximately 80°.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
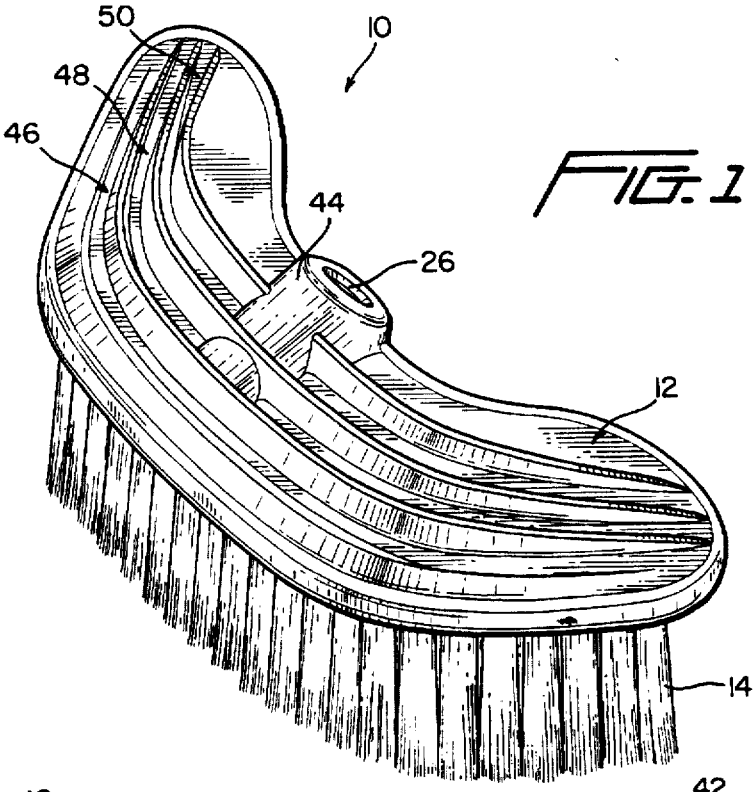
FIG. 1 is a perspective view of a washing brush embodying the teachings of the subject invention with bristles extending from a lower surface of the brush head.
Figure 2:
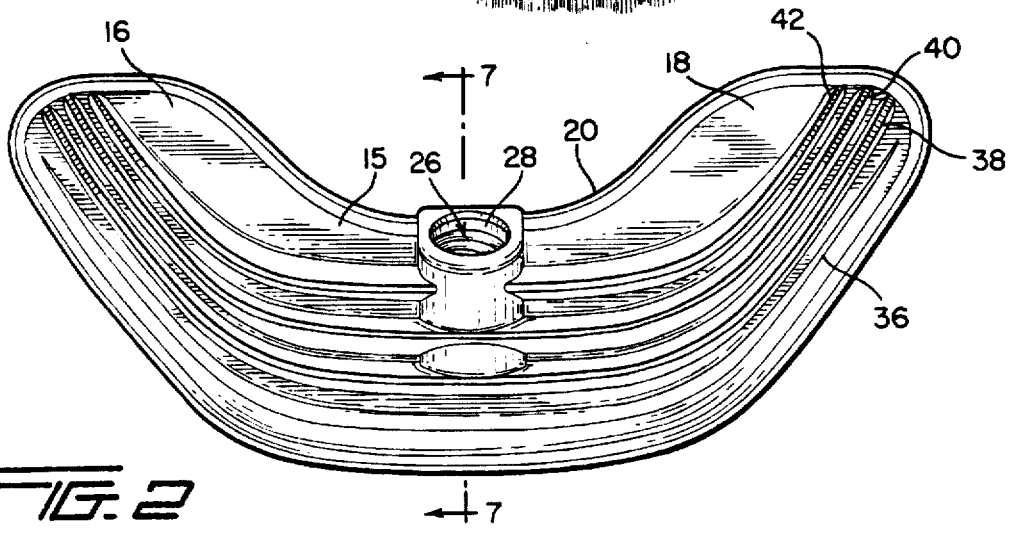
FIG. 2 is a top plan view of the washing brush of the present invention.
Figure 3:
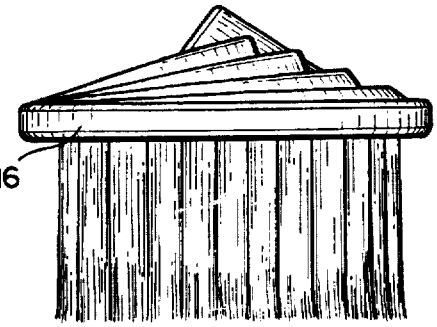
FIG. 3 is a side elevational view of the brush of the present invention.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings in general, and to FIGS. 1 through 7 specifically, a washing brush embodying the teachings of the subject invention is designated as 10. As shown in FIG. 1, the washing brush 10 includes a brush head 12 and a plurality of tufts of bristles 14 extending downwardly from a lower surface of the brush head 12. The brush head 12 includes a central portion 15 from which extend two arms or wing portions 16, 18 extending from a common edge 20 of the central portion.

A rearward extension of the line of projection of the wing portions 16, 18 from the central portion 15 intersects at an angle in the range of 70° to 90°, preferably 75° to 85°, and most preferably about 80°. Formed between the wing portions 16, 18, by the bristles 14 forming the brush, is a curved pocket 22. The pocket 22 is used to gather water as the brush 10 is moved in the direction of arrow 24 along a contoured surface, such as on an automobile.

Figure 4:
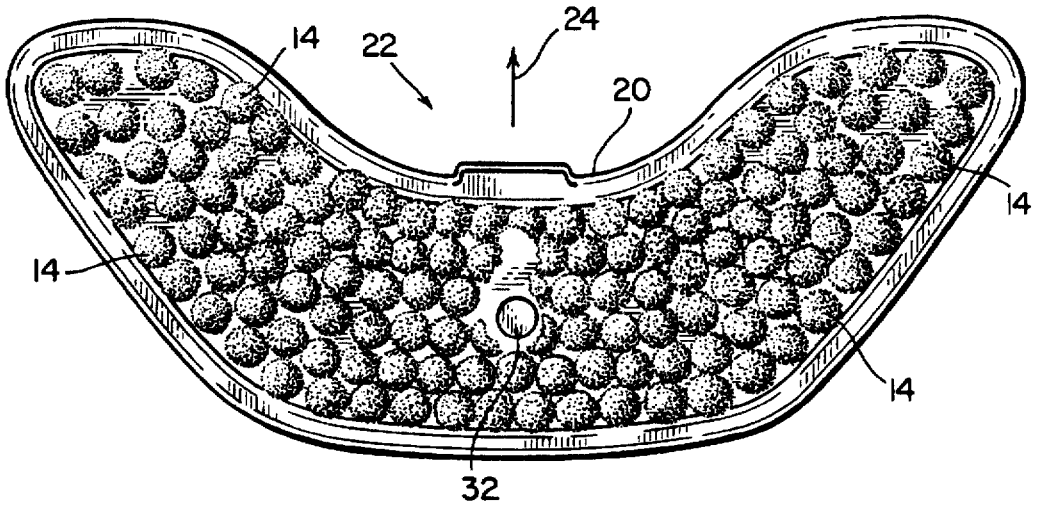
FIG. 4 is a bottom plan view of the brush of the present invention, partially cut-away to expose the water outlet located on the lower surface of the brush head.
Figure 5:
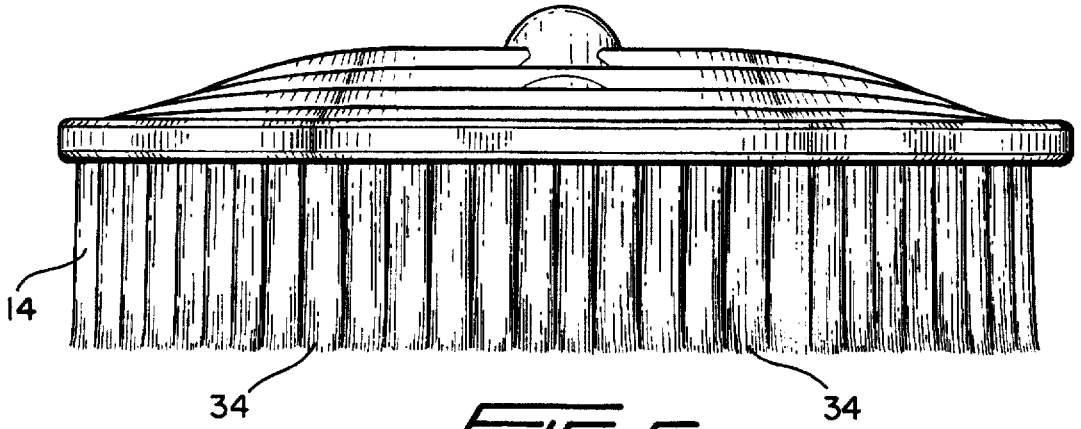
FIG. 5 is a front view of the washing brush of the present invention.
Figure 6:
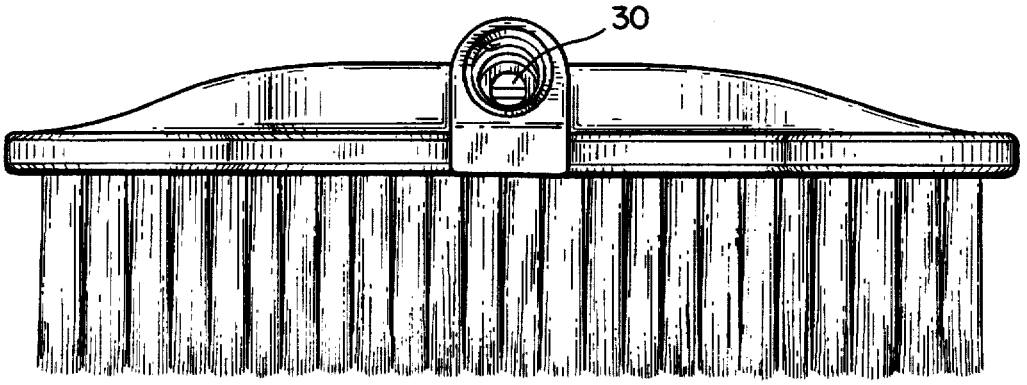
FIG. 6 is a rear view of the brush head of the present invention.

Washing of an automobile, for example, is performed by passage of water through a hose or a hose extension connected to inlet opening 26. Inlet opening 26 includes threads 28 for receipt of the threads of the end of a garden hose or a garden hose extension (not shown). Water introduced into the inlet opening 26 is restricted during its passage through the brush head by a reduced diameter opening 30 in the passageway of the water which increases the pressure of the flow of water through the inlet opening 26 to outlet 32, which is shown in FIGS. 4 and 7.

Figure 7:
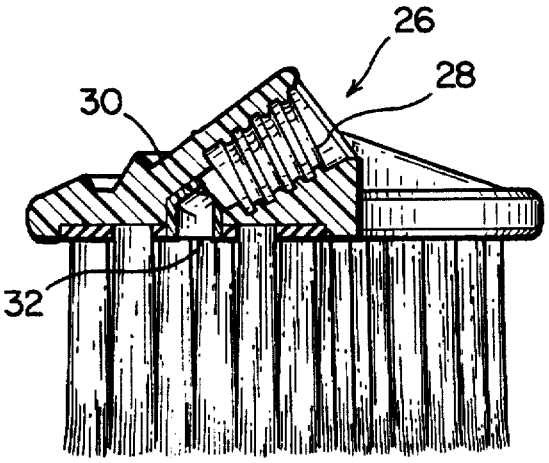
FIG. 7 is a cross-sectional view taken along line 7—7 of FIG. 2.

As can be seen in FIG. 7, the diameter (0.375 inches) of the outlet 32 at the underside of the brush head 12, as compared to the diameter (0.844 inches) of the inlet opening 26, is substantially reduced such that the force of the water passing through the brush head will be increased. It is understood that in FIG. 4, the tufts of bristles 14 entirely fills the lower surface of brush head 12. A section of bristles 14 has been omitted in FIG. 4 to illustrate the outlet 32 opening into the tufts of bristles 14.

The pressure of the water leaving the outlet 32 will, upon contact with the surface to be cleaned, disperse the water across the cleaning lower edge 34 of the tufts of bristles 14 to facilitate the cleaning of a contoured surface. As the brush is moved across the contoured surface in the direction of arrow 24, water already present on the contoured surface and the water from the outlet 32 will be directed, by a funneling effect caused by the angle of extension of the wing portions 16, 18 of the brush 10, to move ahead of the brush and decrease the residue of water remaining after passage of the brush as compared to a known rectangular shaped brush, for example.

On an upper surface of the brush head 12 are formed a plurality of ribs 36, 38, 40, and 42. These ribs generally follow the contour of the brush head except where a raised portion 44 of the inlet opening for the water source projects above the upper surface of the brush head. Formed between the ribs 36 and 38 is a channel 46. Formed between the ribs 38 and 40 is a channel 48. Formed between the ribs 40 and 42 is a channel 50.

Since the height of the ribs increases from the rib 36 to the rib 42, the depth of the channels thereby formed increases from channel 46 to channel 50. These ribs and channels may help obtain a better grip on the brush head as well as allow diversion of the flow of water around the brush head 12 from the central portion 15 towards the wing portions 16, 18 when the brush head is extracted from a bucket of water.

Figure 8:
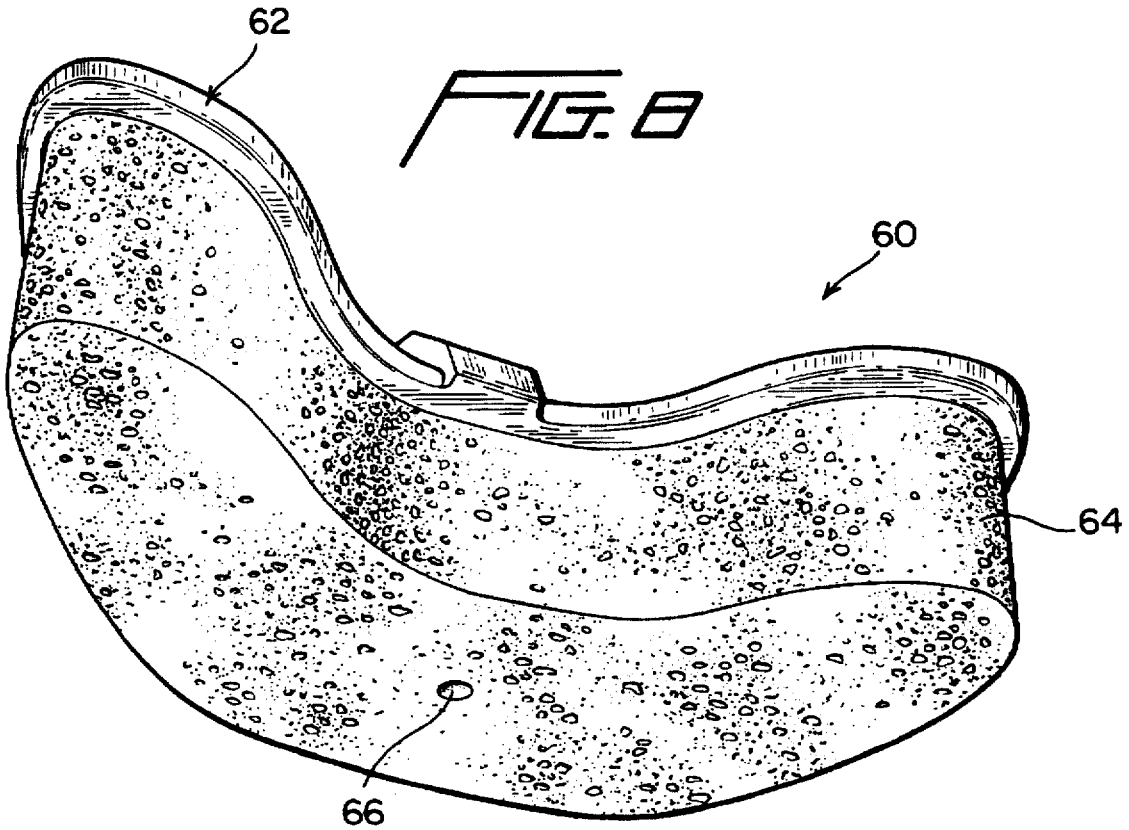
FIG. 8 is a bottom perspective view of a washing brush according to an alternate embodiment of the present invention wherein the body of the brush is formed of a sponge-like material.

Although reference to the washing brush 10 in FIGS. 1 through 7 has been with respect to the use of tufts of bristles, it is envisioned as being within the scope of the present invention, as shown in FIG. 8, to have a washing brush 60 with a brush head 62 in the same configuration as brush head 12, but with a sponge-like material body 64 instead of tufts of bristles 14. In the embodiment shown in FIG. 8, an outlet opening 66 is formed in the sponge like body 64 in alignment with the outlet (not shown) of the brush body 62 which corresponds in location and size to the outlet 32 shown with respect to brush body 12.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A washing brush comprising:

a brush body, a washing body secured to a bottom of said brush body, said brush body including a central portion and two wing portions located on opposite sides of said central portion and extending away from said central portion from a common edge of said central portion, said two wing portions with said central portion forming a collection pocket for collecting water and funnelling the water in a direction of movement of said brush body, a water inlet to said brush body located at said edge of said central portion, said water inlet being located on and said two wing portions extending away from a same side of said central portion, and an upper surface of said brush body including a plurality of ridges following a contour of said central portion and said two wing portions.

2. A washing brush as claimed in claim 1, wherein said wing portions diverge from said central portion at an angle in the range of 70° to 90° from each other.

3. A washing brush as claimed in claim 1, wherein a water passageway extending through said brush body, initiating at said water inlet, is reduced in diameter inside said brush body.

4. A washing brush as claimed in claim 1, wherein said plurality of ridges are separated from each other to form a plurality of channels therebetween.

5. A washing brush as claimed in claim 1, wherein said washing body includes a plurality of bristles.

6. A washing brush as claimed in claim 1, wherein said washing body includes a sponge-like material.

7. A washing brush head comprising:

a brush body including a central portion and two wing portions located on opposite sides of said central portion, said two wing portions extending from one edge of said central portion, a water inlet to said brush body located at said one edge of said central portion, said water inlet being located on and said two wing portions extending away from a same side of said central portion, an outlet located at a lower surface of said brush body, a passageway formed in said brush body in communication with said water inlet and said outlet, a diameter of said passageway being reduced between said water inlet and said outlet, and an upper surface of said brush including a plurality of ridges following a contour of said central portion and said two wing portions.

8. A washing brush as claimed in claim 7, wherein said plurality of ridges are separated from each other to form a plurality of channels therebetween.

9. A washing brush head as claimed in claim 7, wherein a washing body is secured to said lower surface of said brush body.

10. A washing brush as claimed in claim 9, wherein said washing body includes a plurality of bristles.

11. A washing brush as claimed in claim 9, wherein said washing body includes a sponge-like material.

12. A washing brush head as claimed in claim 7, wherein said outlet is centrally located in said lower surface of said brush body.

13. A washing brush head as claimed in claim 7, wherein said wing portions diverge from said central portion at an angle in the range of 70° to 90° from each other to form a collection pocket to funnel water in a direction of movement of said brush body.

* * * * *